US008276307B2

(12) United States Patent
Deros

(10) Patent No.: US 8,276,307 B2
(45) Date of Patent: Oct. 2, 2012

(54) MOUNT ADAPTER DEVICE UTILIZING A PUSH SYSTEM

(76) Inventor: Mark A. Deros, Lubbock, TX (US)

( * ) Notice: Subject to any disclaimer, the term of this patent is extended or adjusted under 35 U.S.C. 154(b) by 0 days.

(21) Appl. No.: 12/895,680

(22) Filed: Sep. 30, 2010

(65) Prior Publication Data

US 2011/0167703 A1 Jul. 14, 2011

Related U.S. Application Data

(60) Provisional application No. 61/277,864, filed on Sep. 30, 2009.

(51) Int. Cl.
*F41C 27/00* (2006.01)

(52) U.S. Cl. ..... 42/127

(58) Field of Classification Search ..... 42/90, 85, 42/106, 124–128
See application file for complete search history.

(56) References Cited

U.S. PATENT DOCUMENTS

| | | | | |
|---|---|---|---|---|
| 5,155,915 | A * | 10/1992 | Repa | 42/127 |
| 5,680,725 | A | 10/1997 | Bell | |
| 6,449,893 | B2 * | 9/2002 | Spinner | 42/127 |
| 6,606,813 | B1 | 8/2003 | Squire | |
| 6,629,381 | B1 | 10/2003 | Keng | |
| 6,931,778 | B1 * | 8/2005 | Nelson et al. | 42/120 |
| 7,107,716 | B1 * | 9/2006 | Liao | 42/108 |
| 7,272,904 | B2 | 9/2007 | Larue | |
| 7,370,449 | B1 * | 5/2008 | Beckmann | 42/90 |
| 7,481,016 | B2 | 1/2009 | Gonzalez | |
| 7,562,485 | B2 * | 7/2009 | Newhall et al. | 42/127 |
| 7,614,175 | B2 | 11/2009 | Davis | |
| 7,654,028 | B1 * | 2/2010 | Grover | 42/85 |
| 7,685,759 | B2 | 3/2010 | Teetzel | |
| 7,703,231 | B2 * | 4/2010 | Wei | 42/90 |
| 7,757,422 | B1 | 7/2010 | Swan | |
| 7,757,423 | B1 | 7/2010 | Swan | |
| 8,020,335 | B2 * | 9/2011 | Larsson et al. | 42/125 |
| 2009/0038201 | A1 | 2/2009 | Cheng | |
| 2010/0107467 | A1 * | 5/2010 | Samson et al. | 42/127 |

* cited by examiner

*Primary Examiner* — Bret Hayes
*Assistant Examiner* — Reginald Tillman, Jr.
(74) *Attorney, Agent, or Firm* — Sarah E. Hegi; McWhorter, Cobb & Johnson, LLP

(57) ABSTRACT

A mount adapter device utilizing a spring-loaded push system for quickly and securely attaching accessories to weapon accessory rails is disclosed. The mount adapter device generally includes a first base member, a second base member, a push rod member, and a resilient member. The push rod member connects the first base member and the second base member. The first base member is linearly slidable into engagement with the second base member in a first direction, and the second base member is linearly slidable into engagement with the first base member in a second direction which is opposite the first direction. The first base member includes a first clamping member for engaging a first edge of the weapon accessory rail. The second base member includes a second clamping member for engaging a second edge of the rail. The resilient member provides a spring force and is arranged to force the first clamping member to move in the first direction into locking engagement with the first edge of the rail while simultaneously forcing the second clamping member to move in the second direction into locking engagement with the second edge of the rail.

27 Claims, 7 Drawing Sheets

MOUNT ADAPTER DEVICE UTILIZING A PUSH SYSTEM

CROSS-REFERENCE TO RELATED APPLICATIONS

This application is related to and claims priority from earlier filed U.S. Provisional Patent Application No. 61/277,864, filed Sep. 30, 2009.

BACKGROUND OF THE INVENTION

1. Field of the Invention

The present invention relates generally to mounting devices for attaching various accessories to a support structure. More specifically, the present invention relates to mount adapter devices utilizing a spring-loaded push system for quickly and securely attaching firearm accessories to weapon accessory rails.

2. Description of the Prior Art

Universal weapon accessory rails such as the "Picatinny rail" (i.e., MIL-STD-1913 rail) provide a standardized platform for mounting and dismounting firearm accessories to weapons. Generally, accessories including optics, tactical lights, grenade launchers, night vision devices, and other weapon-mounted accessories are not designed for direct attachment to the rails. Thus, mount adapter devices are typically employed to attach accessories to firearms.

As depicted in FIG. 2, conventional weapon accessory rails are defined by a grooved mounting feature that serves as the platform used to mount accessories. The grooved mounting feature comprises a plurality of mounting projections 50 extending perpendicular along a longitudinal axis 53 of each rail 43. The mounting projections 50 are separated by a plurality of transverse grooves 40 evenly spaced along the longitudinal axis 53 of the rail 43. Each of the mounting projections 50 includes an upper mounting surface 39 and opposite transverse edges 48 and 49 which are beveled to form a first 41*a* and a second 41*b* inclined proximal surface on opposite sides of the upper mounting surface 39, a first inclined distal surface 42*a* adjacent the first inclined proximal surface 41*a*, and a second inclined distal surface 42*b* adjacent the second inclined proximal surface 41*b*. These mounting projections 50 are provided so that accessories may be mounted to weapon accessory rails using mount adapter devices which are able to grip the edges 48 and 49 of the rails.

Various mount adapter devices have been suggested for attaching weapon accessories to firearms. A common objective of all mount adapter devices is to releasably and securely fasten an accessory to a weapon. To accomplish this objective prior art devices commonly employ bolts, thumbscrews, or levers to draw together opposing clamping members having inclined surfaces aligned with and facing the inclined surfaces of the mounting projections on the rail. The bolt, thumbscrew, or lever urges a moving clamping member toward the direction of a stationary clamping member. In this manner, the opposing clamping members grip the inclined surfaces of the mounting projections in an effort to attach the device to the rail. Design problems in prior art devices, however, present several disadvantages—one significant disadvantage being insufficient clamping forces.

Most users of mount adapter devices, especially military or law enforcement personnel, demand the ability to quickly switch from one accessory to another, as well as the ability to easily and quickly mount and dismount the accessory. Particularly in combat settings, efficient field modification of weapon configurations is vital. Yet, current devices are unable to fulfill such user demands.

Compact and lightweight devices are needed for quickly modifying weapon configurations, but compared to the disclosed invention, prior art devices are large and cumbersome. This design flaw makes tasks such as mounting, dismounting, and switching accessories difficult and time-consuming. Additionally, the comparatively larger prior art devices are more susceptible to being inadvertently forced out of position on the rail by an external force or upon an accidental impact.

A common type of prior art mount adapter device employs levers or similar actuating members as a means of clamping or locking the device to the rail. Such devices require two hands and too much time to attach the device to the rail. One hand positions and holds the device to the rail while the other hand forces the lever to a lock position. This method of attachment does not provide an efficient means of modifying weapon configurations.

Furthermore, a fundamental defect encountered with devices employing levers is that the levers are prone to breakage. For example, due to dimensional variations among different rails, if a particular rail happens to be larger than other conventional rails, a user may have to press harder on a lever in order to get the clamping mechanism to properly attach to the rail. The force exerted on the lever can oftentimes cause the lever to break.

An additional problem of devices employing levers occurs when excessive vibration, recoil, or accidental contact of the lever with an external impact forces the lever to slide to an unlock or release position causing the device and the accessory to detach from the rail. In the case of accessories such as optical sights, a mere one-thousandth of an inch variance in the remounted position causes a one inch shift in the point of aim at one hundred yards. Accordingly, in addition to requiring the user to remount the optical sight, the user would also have to resight (or re-zero) the sight which is inefficient and inconvenient.

Other prior art devices utilize bolts or thumb screws as opposed to levers. Generally, these devices have one or more knobs that the user must rotate through several 360 degree turns in order to attach or detach the device to the rail. Devices of this type cannot be attached to or detached from the rail as quickly as is sometimes required by users.

In regards to accessories such as optical sights, it is imperative for accuracy that the optical sight remains rigidly attached to the firearm. Devices that utilize bolts or thumb screws as a locking means, however, are generally manually bolted down. As a result, the device easily comes loose from the rail as the manually tightened bolts do not remain consistently and tightly fastened in place. Additionally, the bolts and thumbscrews protrude out laterally from the mount adapter device when the device is attached to a rail. This makes the bolts and thumbscrews susceptible to catching or snagging on clothing or other external items which can jerk the device and the accessory out of position.

Another common feature shared by many current devices relies on an opposing cam member to bear against one edge of the rail to attach the device to the rail. Generally, the length of the opposing cam member is substantially less than the length of a main clamping member. For example, in one design currently used, the opposing cam member measures approximately one half of an inch in length while the main clamping member measures approximately three inches in length. This feature results in insufficient holding strength of the device to the rail and leaves the accessory susceptible to misalignment caused by accidental impact, intense recoil, or jarring or dropping the firearm on which the accessory is mounted. Once again this can force the user to waste a great amount of time correcting the positioning, remounting, or resighting the accessory.

Another problem with devices utilizing a cam member occurs as the cam member moves into a clamping position on the rail. The cam member rubs along and abrades an edge of the rail each time the device is attached to or detached from the rail. This disfigures and wears down the edges of the rails which reduces the ability of such devices to consistently, tightly, and securely attach to the damaged edges. Furthermore, devices utilizing cam members are not designed to account for the dimensional variations seen among different rails. This results in such devices either attaching too tightly to rails and disfiguring the rails as described above, or attaching to loosely to rails and leaving the attached accessory susceptible to misalignment or detachment.

A mount adapter device is needed that is compact, lightweight, and that provides maximum and consistent clamping forces to attach the device to a rail, thereby allowing the device to withstand the impact of external forces. At the same time the device needs to be sturdy enough to withstand breakage of any parts. Moreover, a device is needed that will securely lock to all rails, including worn or damaged rails, without disfiguring the rails or requiring realignment. Opposed to prior art devices that require tools or two hands to attach the devices to a rail, a device is needed that can be quickly and effortlessly locked to a rail without the necessity of tools and requiring only one hand. A device is needed that will retain its precise original orientation and alignment when detached and reattached to a rail, thereby allowing an optical, sighting, or other aiming or targeting device to maintain its zero position when detached and then subsequently reattached to the rail.

In view of the foregoing, it is apparent that there exists a need in the art for a mount adapter device which overcomes, mitigates, or solves the above problems in the art. It is a purpose of this invention to fulfill this and other needs in the art which will become more apparent to the skilled artisan once given the following disclosure.

OBJECTS AND SUMMARY OF THE INVENTION

It is an object of the present invention to overcome the above described drawbacks associated with prior art mount adapter devices. To achieve these and other advantages and in accordance with the purpose of the invention, as embodied and broadly described, the invention provides for a mount adapter device utilizing a spring-loaded push system that employs a dual locking mechanism to releasably, consistently, and securely lock accessories to a universal weapon accessory rail.

The mount adapter device of the present invention generally comprises a base including a first base member and a second base member, said first base member being linearly slidable into engagement with the second base member in a first direction, said second base member being linearly slidable into engagement with the first base member in a second direction which is opposite said first direction; said first base member including a first clamping member for engaging a first edge of the rail; said second base member including a second clamping member for engaging a second edge of the rail; a push rod member slidably connecting said first base member to said second base member, said push rod member including a shaft and a knob, said shaft including a first end and a second end, and said knob attached to said first end of the shaft; and a resilient member being received around said push rod member, said resilient member providing a spring force and arranged to force the first clamping member to move in said first direction into locking engagement with the first edge of the rail while simultaneously forcing the second clamping member to move in said second direction into locking engagement with the second edge of the rail.

In operation, the first base member is connected to the push rod member in a manner that allows the first base member to slide up and down the shaft between the knob and the second base member. The second base member is threadedly fastened to the second end of the push rod member so that the second base member remains attached to the second end of the push rod member at all times. The resilient member provides a spring force which urges the first base member in a first direction down the shaft of the push rod member toward engagement with the second base member and which yieldably opposes movement of the first base member up the shaft toward the knob. At the same time, the resilient member bears against the knob which urges the push rod member in a second direction, opposite the first direction. The second end of the push rod member is attached to the second base member so that the spring force simultaneously urges the second base member in the second direction along with the push rod member.

In this manner, the resilient member in association with the push rod member creates two directly opposing and moving forces urging the first base member in the first direction and the second base member in the second direction thereby forcing the first and second base members into engagement with one another. This forces the opposing clamping members of the first and second base members into locking engagement with the opposite transverse edges of the rail when the device is placed on the rail. Rather than employ a single moving force coming from one direction, as is seen in the prior art devices, the present invention locks to the rail by employing two directly opposing moving forces coming from two opposite directions. This results in two opposing forces, which are approximately equal in magnitude, being applied to the two opposite transverse edges of the rail.

This spring-loaded push system feature provides numerous advantages over prior art devices. Most notably, rather than employing a moving force coming from one direction, the present device employs two directly opposing moving forces coming from two opposite directions which provides the device with maximum attachment and holding strength that is unparalleled in the art.

Another advantage provided by the spring-loaded push rod system is that it allows the device to be quickly locked to or unlocked from a rail using only one hand and without the necessity of tools. Moreover, the spring-loaded push system allows the device to self-adjust to compensate for variations in rail dimensions thereby providing a secure and consistent attachment to any rail, including a worn or disfigured rail, as well as providing a locking means that does not damage the rail. Additionally, the spring-loaded push system provides for a uniform tension on all rails regardless of the strength of the user who attaches the device to the rail.

A further advantage resides in the ability of the device to maintain at least three points of contact with a plurality of mounting projections at all times, whether or not the rail is worn or disfigured. The opposing clamping members facing the first and second inclined proximal surfaces of the mounting projections do not contact said first and second inclined proximal surfaces which allows the device to fit any rail, including rails with damaged edges. The three points of contact are provided by a lower mounting surface of the first base member, which bears against the upper mounting surfaces of the mounting projections, and the opposing clamping members of the first and second base members, which engage the first and second inclined distal surfaces of the mounting projections. This three-point contact provided for by the device, in combination with the two opposing moving forces provided by the spring-loaded push system, provides maximum holding strength which is unparalleled in this field. Experimental tests have demonstrated that the mount adapter device of the present invention can lift at least 1,600 pounds while mounted to a conventional weapon accessory rail without damaging the rail.

Another advantage of the presently disclosed device resides in the ability of the device to maintain additional points of contact with one or more elected transverse grooves at all times. This advantage is provided by the central portion of the shaft of the push rod member and may be provided by one or more locating members. The central portion of the shaft and the locating members are configured to engage elected transverse grooves between the mounting projections on the rail to prevent forward and backward movement of the device along the longitudinal axis of the rail. The combination of the three-point contact with the mounting projections and the additional points of contact maintained between the push rod member and the locating members with the transverse grooves provides additional holding strength, the ability to withstand intense recoil and external impacts, and the ability to retain the precise original orientation and alignment of the accessory on the firearm upon detachment and reattachment of the device. In this manner, precisely aligned accessories such as sighting, aiming, or targeting devices may be detached from and reattached to the rail without the need for resighting the device.

Another object of the present invention is to provide a lightweight and compact device that offers no point of entanglement for military or law enforcement personnel's equipment. Still another object is to provide a device that has no loose components that would render the device inoperable should one be inadvertently lost.

These, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there is illustrated a preferred embodiment of the invention.

Though the present invention is discussed herein particularly with its application to mount adapter devices for firearms, note that it is not intended to limit the spirit and scope of the present invention solely to use in conjunction with firearms. The present invention clearly has a wide range of application in circumstances where a device is intended to be releasably attached in a secure manner to a support structure. Many other uses of the present invention will become obvious to one skilled in the art upon acquiring a thorough understanding of the present invention.

BRIEF DESCRIPTION OF THE DRAWINGS

The accompanying drawings, which are incorporated in and form a part of the specification, illustrate a preferred embodiment of the present invention, and together with the description, serve to explain the principles of the invention. It is to be expressly understood that the drawings are for the purpose of illustration and description only and are not intended as a definition of the limits of the invention. In the drawings.

DETAILED DESCRIPTION OF THE PREFERRED EMBODIMENT

Figure 1A:
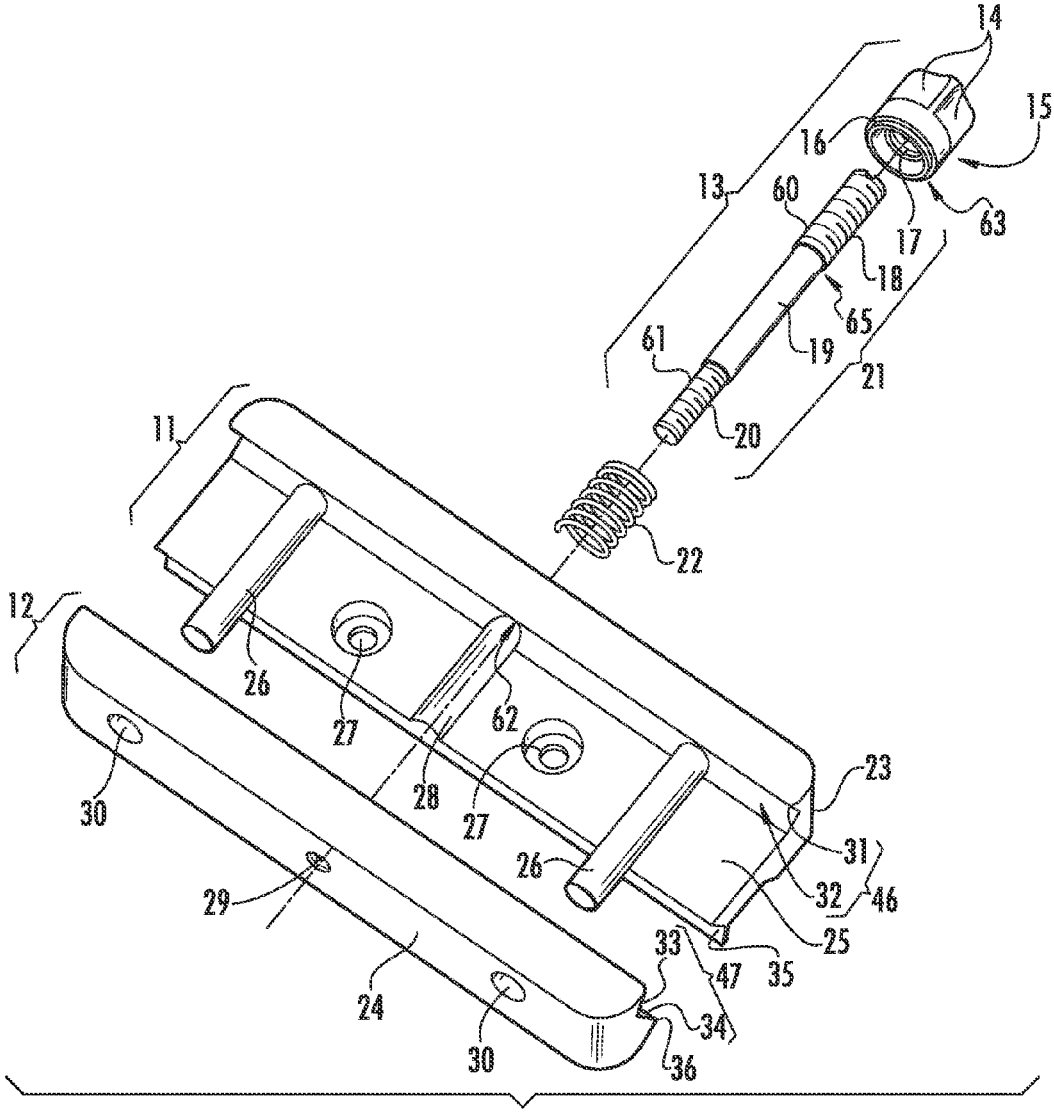
FIGS. 1A and 1B illustrate exploded isometric views of one example of a mount adapter device constructed in accordance with the teachings of the present disclosure.

Referring now to FIGS. 1A-6, an exemplary embodiment of a mount adapter device in accordance with the present disclosure is illustrated and generally includes a push rod member 13, a resilient member 22, a first base member 11, and a second base member 12.

The push rod member 13 includes a knob 15 fastened to a first end 18 of a shaft 21. The knob 15 includes a centrally threaded aperture 17 therein which allows the knob 15 to be rotated up and down the first end 18 of the shaft 21 of the push rod member 13. The knob 15 may include a design such as the inverse U-shaped depressions 14 illustrated in the depicted embodiment. Such feature provides an attractive design and an additional gripping surface for rotating the knob 15 up and down the first end 18 of the shaft 21. Furthermore, a sealing member 16, such as a plastic gasket, may be disposed around a lower portion 63 of the knob 15 such that, upon assembly of the device 70, the sealing member 16 may be interposed between the knob 15 and the first base member 11 when the knob 15 is rotated down to the bottom 65 of the first end 18 of the shaft 21.

Figure 3:
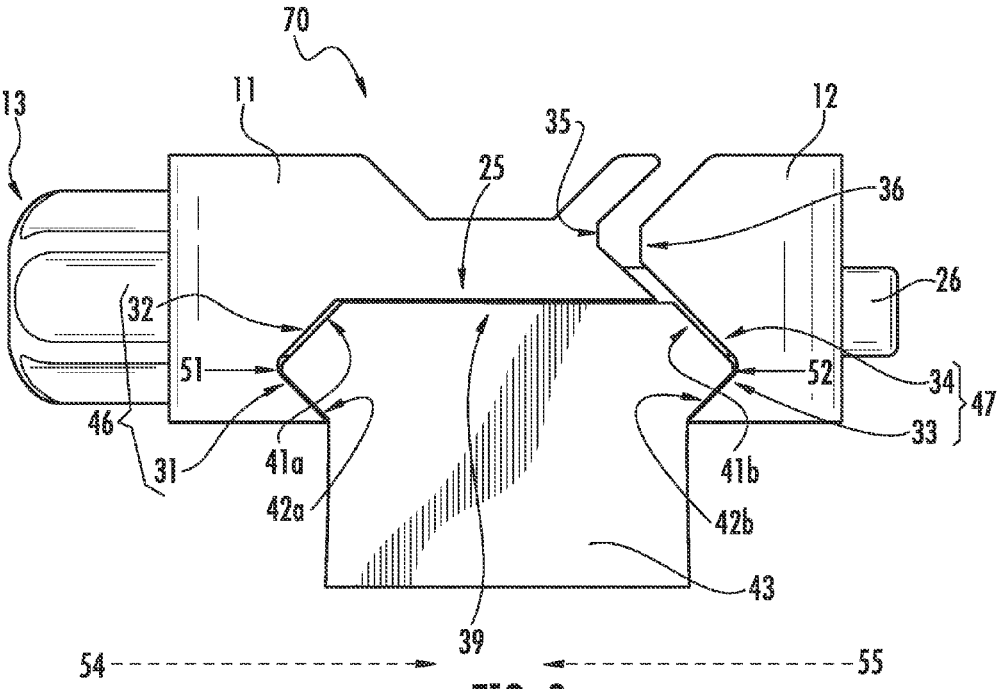
FIG. 3 is an end elevational view of the device shown in FIGS. 1A and 1B mounted to the rail shown in FIG. 2.
Figure 4A:
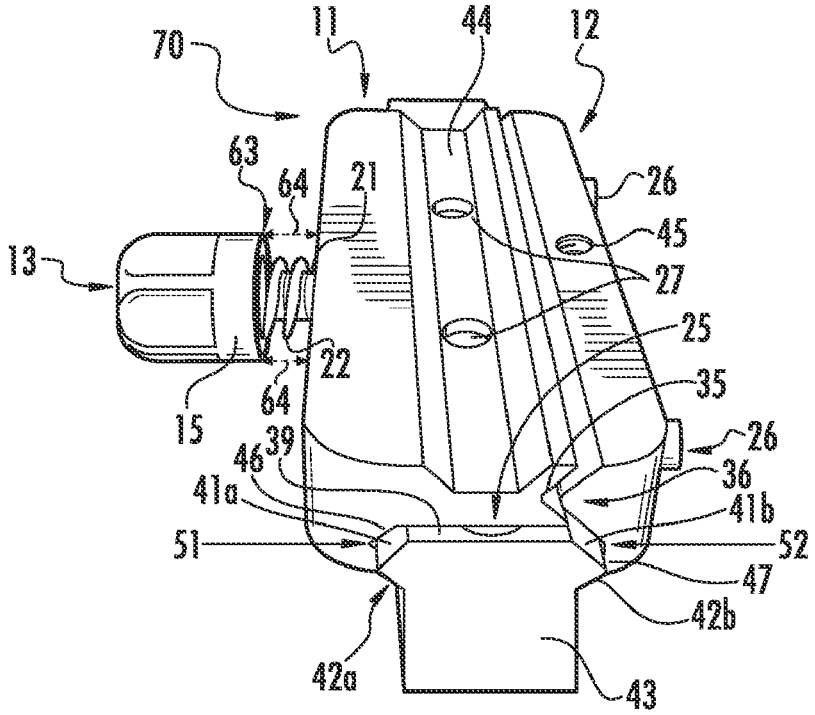
FIG. 4A is an isometric view of the top side of the device shown in FIGS. 1A and 1B mounted to the rail shown in FIG. 2 in a first locked position.
Figure 4B:
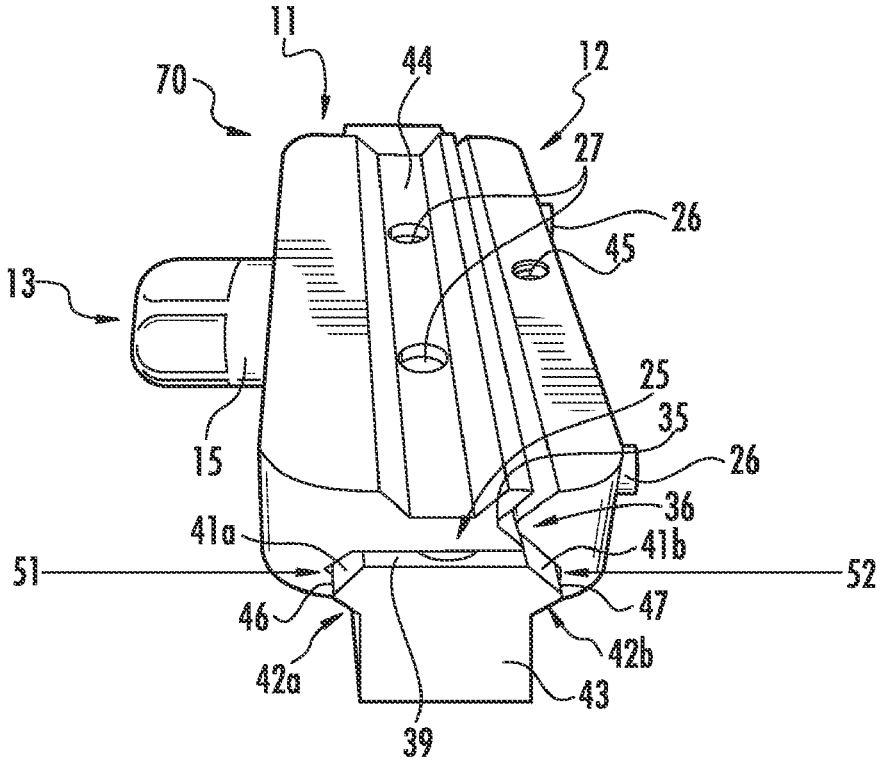
FIG. 4B is an isometric view of the top side of the device shown in FIGS. 1A and 1B mounted to the rail shown in FIG. 2 in a second locked position.

In the depicted embodiment, the shaft 21 of the push rod member 13 includes a first end 18 and a second end 20 which are divided by a central portion 19. The first end 18 is threaded and is non-contiguous with the second end 20 which is also threaded. The first end 18 may include large threads 60 which have a greater major and minor diameter than the small threads 61 on the second end 20 of the shaft 21. The large threads 60 on the first end 18 are designed to prevent the first end 18 of the shaft 21 from passing through a first aperture 62 in the first base member 11, upon assembly of the device 70. Additionally, the large threads 60 provide the device 70 with increased holding strength when the device 70 is in a second locked position, as represented in FIGS. 3 and 4B, which is discussed in detail below. The second end 20 is threaded to provide a means of fastening the push rod member 13 to the second base member 12. The second base member 12 has a second aperture 29 therein which is internally threaded in order to receive and retain the second end 20 of the push rod member 13.

Figure 5A:
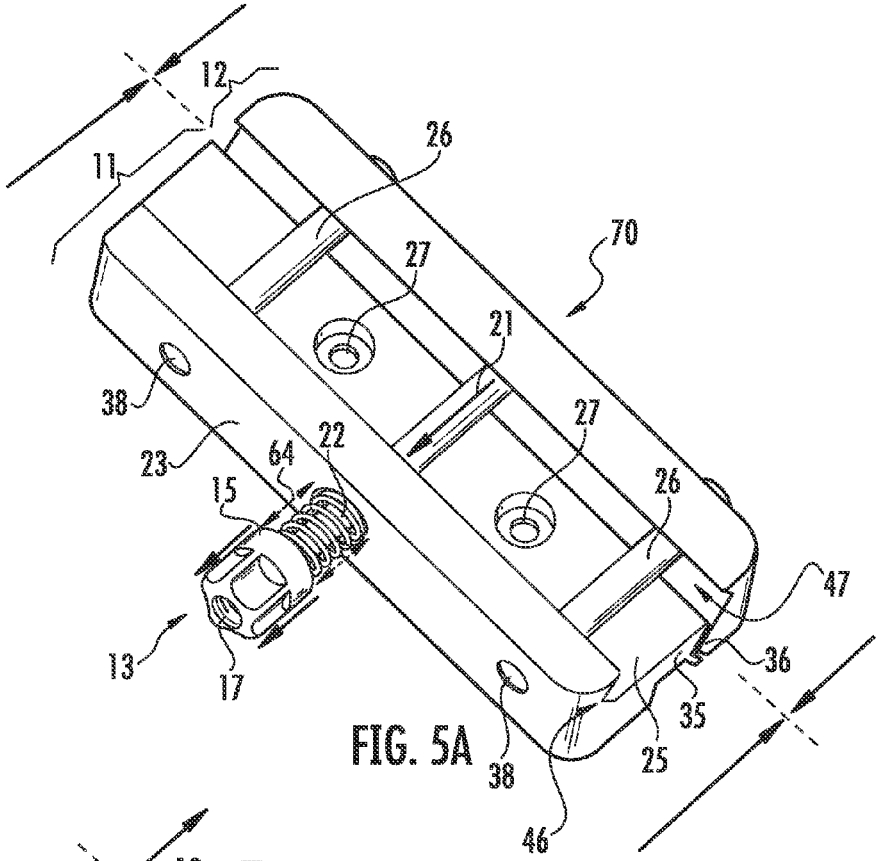
FIG. 5A is an isometric view of the bottom side of the device shown in FIGS. 1A and 1B illustrating the device in a closed position wherein a resilient member urges a first base member into engagement with a second base member.
Figure 5B:
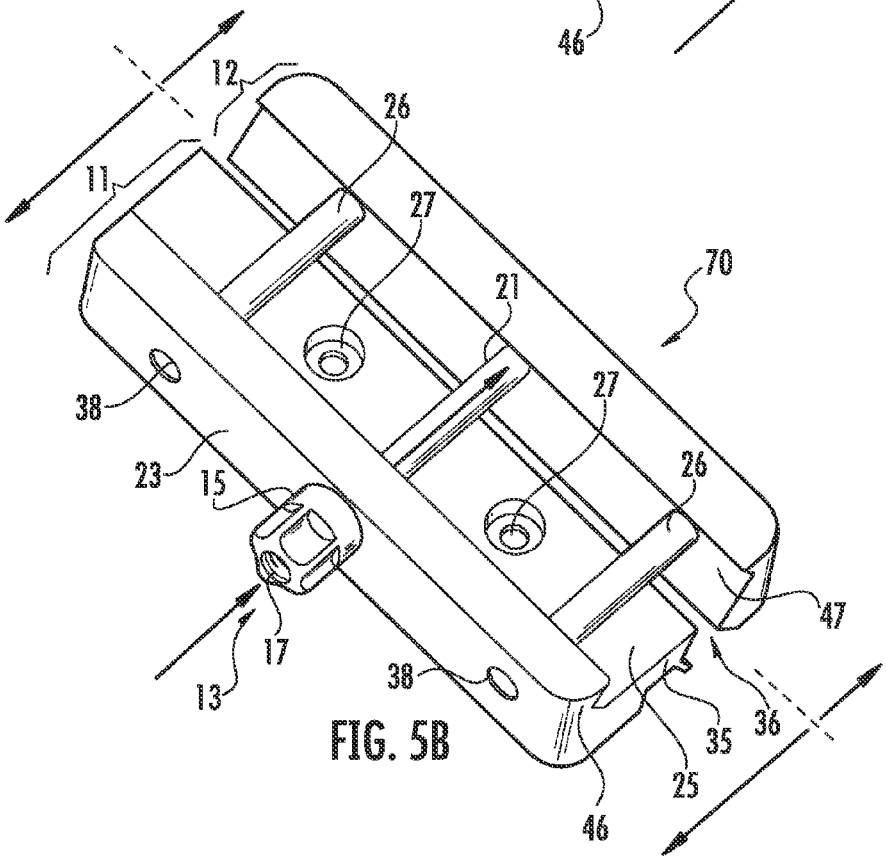
FIG. 5B is an isometric view of the bottom side of the device shown in FIGS. 1A and 1B illustrating the device in an opened position wherein a push rod member is being pushed to disengage the second base member from the first base member so that the device could be attached to or detached from a weapon accessory rail (not illustrated).
Figure 6:
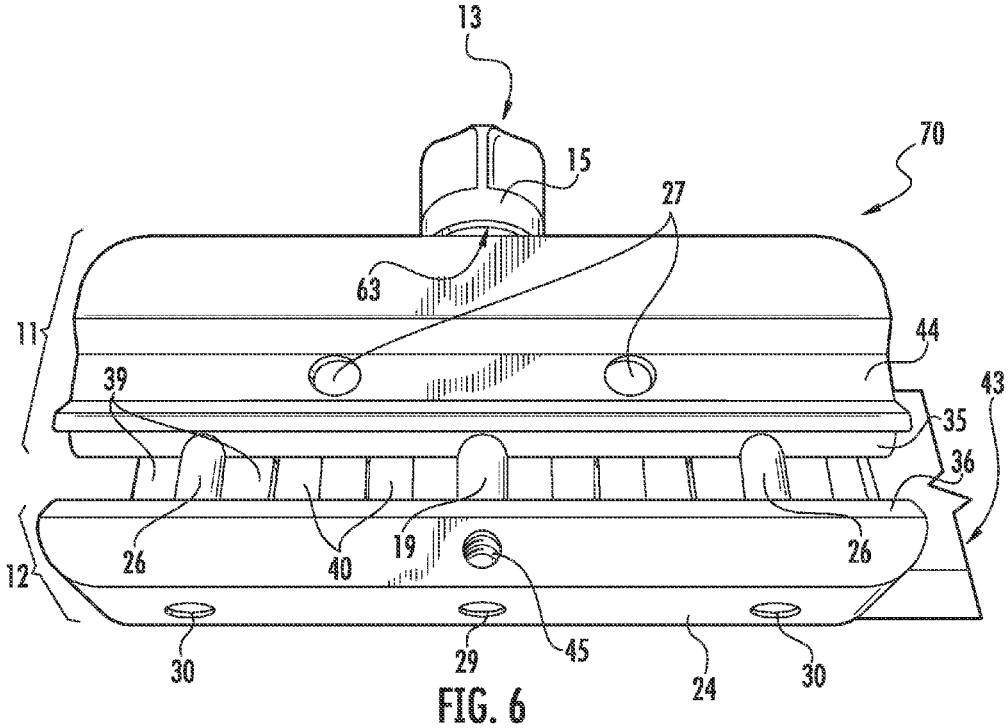
FIG. 6 is an isometric view of the top side of the device shown in FIGS. 1A and 1B illustrating the device in the opened position wherein the device is being attached to or detached from the rail shown in FIG. 2 and wherein the push rod member and two locating members are shown engaging transverse grooves of the rail.

The first 18 and second 20 threaded ends of the shaft 21 may be divided by a central thread-free portion 19. Upon assembly of the device 70, this thread-free portion 19 may be disposed on a lower mounting surface 25 of the first base member 11 so that this thread-free portion 19 projects from the lower mounting surface 25 (as shown in FIGS. 5A and 5B) in order to engage an elected groove 40 of the rail 43 upon attachment of the device 70 to the rail 43 (as shown in FIG. 6).

In the depicted embodiment, the resilient member 22 is a spring which is received around the shaft 21 of the push rod member 13 and is captured between a lower portion of the knob 63 and a central recess 37 in a first lateral surface 23 of the first base member 11. The resilient member 22 provides a spring force 64 which urges the first base member 11 into engagement with the second base member 12 such that when the device 70 is not being used it is in a closed position, as is represented in FIG. 5A.

The first base member 11 includes a first clamping member 46 having a first inclined proximal surface 32 adjacent to the lower mounting surface 25 and a first inclined distal surface 31 adjacent to the first inclined proximal surface 32. The first base member 11 further includes a first engagement member 35 configured to engage the second base member 12 when the device 70 is in a closed position, such as when the device is not attached to a rail and is not being manipulated by a user (shown in FIG. 5A). Further, the first base member 11 includes an upper (in the orientation shown in FIGS. 2-4B and 6) portion 44 configured to receive and retain an accessory (not illustrated). In the depicted embodiment, the upper portion 44 includes a pair of apertures 27 allowing passage of a fastener through the aperture 27 for securing an accessory to the upper portion 44. Other means for securing an accessory to the device 70 that are known in the art may also be used and are considered to be within the spirit and scope of the present invention. Additionally, the upper portion may be configured to receive and retain an additional rail structure to allow for direct attachment of an accessory to the additional rail structure.

The second base member 12 includes a second clamping member 47 that opposes the first clamping member 46. The second clamping member 47 has a second inclined proximal surface 34 adjacent to the lower mounting surface 25 and a second inclined distal surface 33 adjacent to the second inclined proximal surface 34. The second base member 12 further includes a second engagement member 36 configured to engage the first engagement member 35 of the first base member 11 when the device 70 is in a closed position (shown in FIG. 5A).

Figure 2:
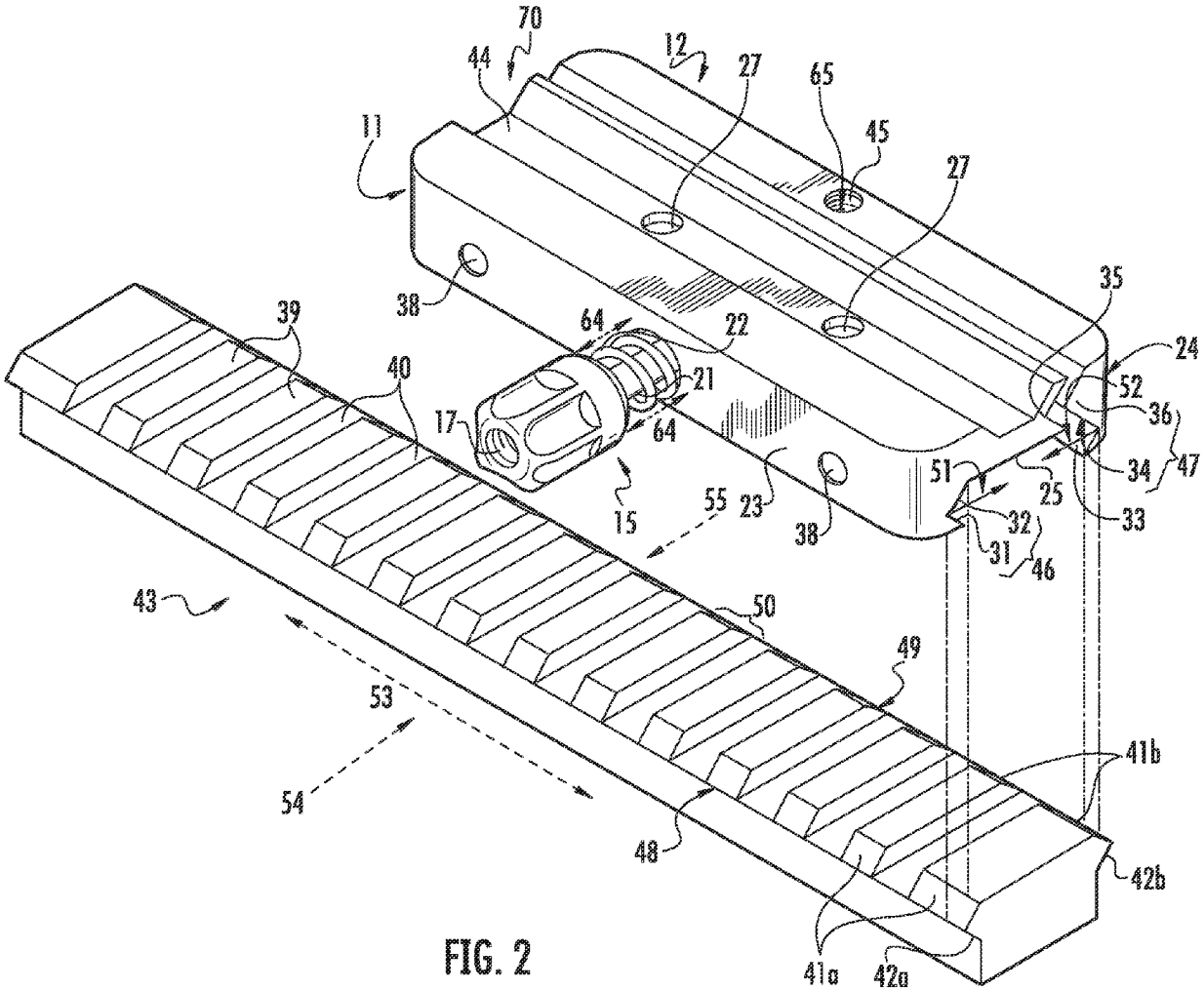
FIG. 2 is an isometric view illustrating the device shown in FIGS. 1A and 1B aligned over a weapon accessory rail.

As depicted in FIG. 2, the opposing first 46 and second 47 clamping members are approximately equal in length (that is, in the direction of the longitudinal axis 53 of the rail 43) and provide two opposing moving clamping forces 51 and 52, which are approximately equal in magnitude, against opposite transverse edges 48 and 49 of the rail 43. The two opposing moving clamping forces 51 and 52 come from two opposite directions 54 and 55, which are transverse to the longitudinal axis 53 of the rail 43.

The first 11 and second 12 base members are connected by first inserting the second end 20 of the shaft 21 of the push rod member 13 through a first aperture 62 in the first lateral surface 23 of the first base member 11 until the large threads 60 projecting radially from the first end 18 of the shaft 21 prevent the shaft 21 from being further received through the first aperture 62. After the shaft 21 is slidably received through the first aperture 62, the central portion 19 of the shaft 21 is positioned in a channel 28, formed in the lower mounting surface 25 of the first base member 11, which is configured and arranged for sliding engagement with the central portion 19 of the shaft 21. The second end 20 of the shaft 21 is subsequently fastened to a second aperture 29, which is internally threaded. The second aperture 29 is located in a second lateral surface 24 of the second base member 12 and is positioned to align with the first aperture 62 in the first base member 11. The second aperture 29 is configured to receive and retain the threaded portion of the second end 20 of the shaft 21 of the push rod member 13. Upon assembly, the resilient member 22 is received around the shaft 21 of the push rod member 13 and is captured between a lower portion of the knob 63 and a central recess 37 in the first lateral surface 23 of the first base member 11.

Figure 1B:
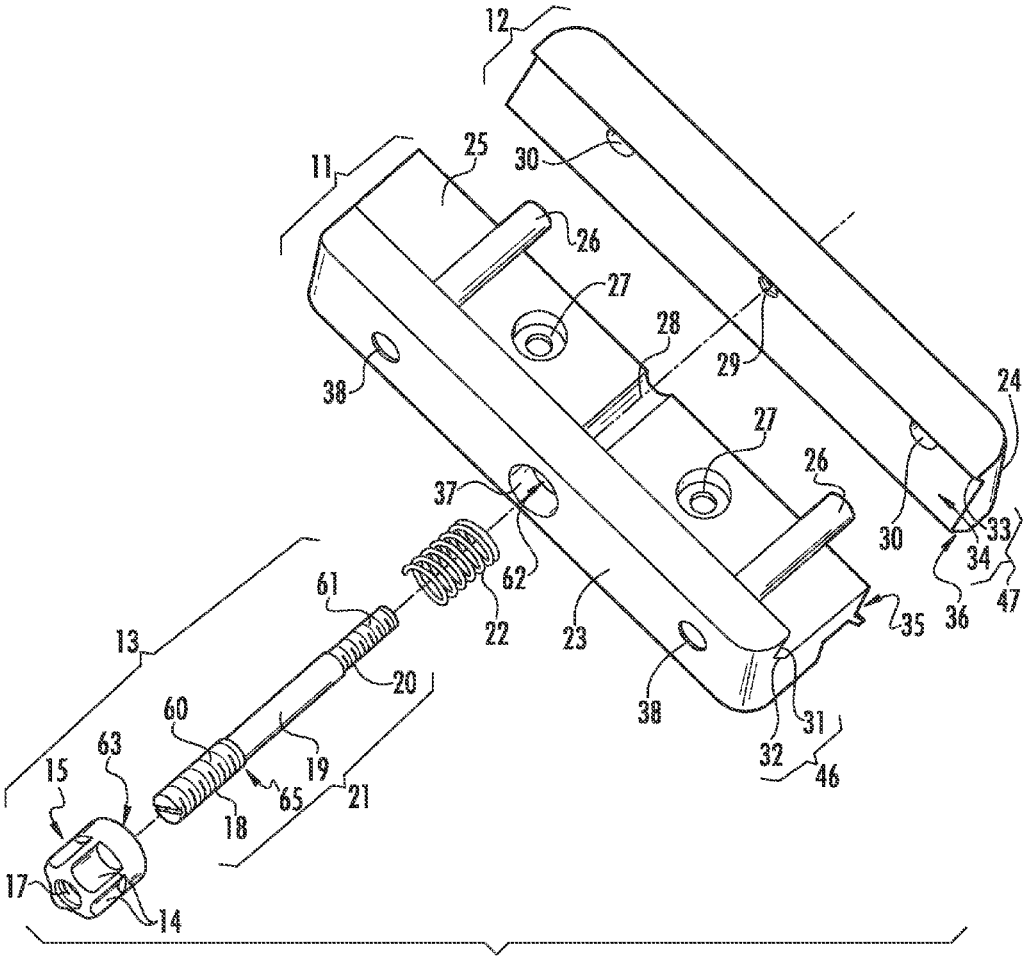

In certain embodiments contemplated by this invention, locating members 26 may be optionally provided to limit the movement of the device 70 along the longitudinal axis 53 of the rail 43. In the depicted embodiment, the mount adapter device 70 includes two locating members 26 fixed to the first base member 11 through apertures 38 formed therein. The locating members 26 are disposed on the lower mounting surface 25 of the first base member 11. When the device 70 is installed on the rail 43 (as shown in FIG. 6), locating members 26 are configured to engage elected grooves 40 between mounting projections 50 in order to restrict any forward or backward movement of the device 70 along the longitudinal axis 53 of the rail 43. The locating members 26 may define elongated rods as in the depicted embodiment, wherein a terminal end of each locating member 26 may extend past the lower mounting surface 25 of the first base member 11 (as shown in FIGS. 1A and 1B) in order to be slidably received by a complimentary locating member aperture 30 located in the second base member 12. Although the accompanying Figures illustrate the device 70 as including two locating members 26, other embodiments are contemplated wherein greater or lesser numbers of locating members 26 are employed, zero locating members 26 being necessary.

A threaded set screw 45 may be threadedly received within an internally threaded set screw aperture 63 in the second base member 12, as shown in FIG. 2. The set screw 45 may be rotated until it bears against the second end 20 of the push rod member 13 so as to retain the push rod member 13 at a desired rotational position and to prevent disengagement of the push rod member 13 from the second base member 12.

In operation, the first base member 11 is connected to the push rod member 13 in a manner that allows the first base member 11 to slide up and down the shaft 21 between the knob 15 and the second base member 12, as shown in FIGS. 5A and 5B. The second base member 12 is threadedly fastened to the second end 20 of the shaft 21 so that the second base member 12 remains attached to the second end 20 of the push rod member 13 at all times. As shown in FIGS. 2 and 5A, the resilient member 22 provides a spring force 64 which urges the first base member 11 in a first direction 54 toward engagement with the second base member 12, and which yieldably opposes movement of the first base member 11 in a second direction 55 toward the knob 15. At the same time, the spring force 64 of the resilient member 22 bears against the lower portion 63 of the knob 15 which urges the push rod member 13 in a second direction 55, opposite the first direction 54. The second end 20 of the push rod member 13 is attached to the second base member 12 so that the spring force 64 simultaneously urges the second base member 12 along with the push rod member 13 in the second direction 55. In this manner, as is represented in FIG. 2, the resilient member 22, in association with the push rod member 13, creates two opposing and moving clamping forces 51 and 52 by urging the first base member 11 in the first direction 54 and the second base member 12 in the second direction 55, which is opposite the first direction 54. This forces the opposing clamping members 46 and 47 into locking engagement with the opposite transverse edges 48 and 49 of the rail 43.

Therefore, the present invention locks to the rail 43 by employing two directly opposing moving forces 51 and 52 coming from two opposite directions 54 and 55. This results in two opposing forces 51 and 52, which are approximately equal in magnitude, being applied to the opposite transverse edges 48 and 49 of the rail 43.

The spring force 64 provided by the resilient member 22 may be overcome by manually pushing the push rod member 13 to disengage the first base member 11 from the second base member 12 thereby moving the first 11 and second 12 base members into an opened position (as illustrated in FIG. 5B). This increases the distance between the opposing clamping members 46 and 47 of the first 11 and second 12 base members. With the push rod member 13 depressed and the device 70 in the opened position, the device 70 is positioned on the rail 43 so that the lower mounting surface 25 bears against the upper mounting surfaces 39 of the mounting projections 50 and the central portion 19 of the shaft 21 of the push rod member 13, along with any locating members 26, is aligned and engaged with an elected transverse groove 40 on the rail 43 (as shown in FIG. 6).

The depressed push rod member 13 is then released which causes the resilient member 22 to decompress thereby forcing the first base member 11 in a first direction 54 toward engagement with the second base member 12 while simultaneously forcing the second base member 12 in a second direction 55, opposite the first direction 54, toward engagement with the first base member 11. Movement of the first 11 and second base members 12 forces the opposing clamping members 46 and 47 to bear against the opposite transverse edges 48 and 49 of the rail 43 via two opposing and moving clamping forces 51 and 52 which come from two opposite directions 54 and 55. In this manner, the device 70 provides for a first locked position (shown in FIG. 4A) which allows the device 70 to be attached to the rail 43 in approximately 1 second by pushing the push rod member 13, placing the device 70 on the rail 43, and then releasing the push rod member 13.

Furthermore, the push rod member 13 provides for a second locked position (shown in FIGS. 3 and 4B). Starting from the first locked position with the device 70 attached to the rail 43, the knob 15 is rotated down the first end 18 of the shaft 21 toward the first base member 11 until the lower portion of the knob 63 is adjacent the first lateral surface 23 of the first base member 11. This second locked position fixedly locks the first base member 11, along with the first clamping member 46, and the second base member 12, along with the second clamping member 47, to the rail 43. The second locked position provides the device 70 with maximum holding strength that is unparalleled and unheard of in this field.

FIG. 3 depicts the three points of contact that occur between the device 70 and a plurality of mounting projections 50 when the device is in the first locked position (shown in FIG. 4A) or the second locked position (shown in FIGS. 3 and 4B). The first clamping member 46 engages the first inclined distal surfaces 42*a* of a plurality of mounting projections 50, the second clamping member 47 engages the second inclined distal surfaces 42*b* of a plurality of mounting projections 50, and the lower mounting surface 25 bears against the upper mounting surfaces 39 of a plurality of mounting projections 50. A small amount of space separates both the first clamping member 46 from the first inclined proximal surfaces 41*a* of the mounting projections 50 and the second clamping member 47 from the second inclined proximal surfaces 41*b* of the mounting projections 50. This design allows the device 70 to fit any rail, including worn or disfigured rails. Moreover, the three-point contact provided for by the device 70 yields maximum holding strength which is unmatched by prior art devices.

In addition to providing an easy and quick attachment method, the device 70 also may be easily and quickly detached from the rail 43. Starting in the first locked position (shown in FIG. 4A), simply push the push rod member 13 in a direction 54 that is transverse to the longitudinal axis 53 of the rail 43. This disengages the opposing clamping members 46 and 47 from the rail 43 so that the device 70 is in the opened position (shown in FIG. 6) and may be simply lifted off the rail 43.

While the present invention has been illustrated by the description of one or more embodiments thereof, and while the embodiments have been described in considerable detail, the foregoing is considered as illustrative only of the principles of the invention and it is not intended to restrict or in any way limit the scope of the appended claims to such detail. Once given the above disclosures, many other features, modifications, and variations will become apparent to the skilled artisan in view of the teachings set forth herein. Such other features, modifications, and variations are therefore considered to be a part of this invention, the scope of which is to be determined by the following claims.

The invention claimed is:

1. A mount adapter device for releasably attaching an accessory to a rail attached to a structure, said rail including a plurality of mounting projections extending perpendicular along a longitudinal axis of the rail and separated by a plurality of transverse grooves spaced along the longitudinal axis of the rail, each of said mounting projections including an upper mounting surface and opposite transverse edges defining first and second inclined proximal surfaces on opposite sides of the upper mounting surface, a first inclined distal surface adjacent to said first inclined proximal surface, and a second inclined distal surface adjacent to said second inclined proximal surface, said mount adapter device comprising:

a base including a first base member and a second base member, said first base member being linearly slidable into engagement with the second base member in a first direction, said second base member being linearly slidable into engagement with the first base member in a second direction which is opposite said first direction; said first base member including a first clamping member for engaging a first edge of the rail; and said second base member including a second clamping member for engaging a second edge of the rail which is opposite said first edge;

a push rod member connecting said first base member to said second base member; and a resilient member being received around said push rod member, said resilient member providing a spring force and arranged to force the first clamping member to move in said first direction into locking engagement with the first edge of the rail while simultaneously forcing the second clamping member to move in said second direction into locking engagement with the second edge of the rail.

2. The mount adapter device according to claim 1, wherein said base further includes an upper portion configured to receive and retain said accessory.

3. The mount adapter device of claim 1, wherein said resilient member is a spring.

4. The mount adapter device of claim 1, further comprising at least two said push rod members.

5. The mount adapter device according to claim 1, wherein said first base member further includes a first lateral surface having a first aperture therein for slidably receiving said push rod member.

6. The mount adapter device according to claim 1, wherein said second base member further includes a second lateral surface having a second aperture therein for receiving and retaining an end of said push rod member.

7. The mount adapter device according to claim 1, wherein said device is attached to the rail by pushing said push rod member in a direction which is transverse to the longitudinal axis of the rail, positioning the device on the rail, and releasing said push rod member.

8. The mount adapter device according to claim 7, wherein said device is detached from the rail by pushing said push rod member in a direction which is transverse to the longitudinal axis of the rail and lifting the device off the rail.

9. The mount adapter device according to claim 1, wherein said base further includes a lower mounting surface configured to engage said upper mounting surfaces of the mounting projections.

10. The mount adapter device according to claim 9, wherein said device is configured to maintain at least three points of contact with said plurality of mounting projections of the rail upon attachment of the device to the rail.

11. The mount adapter device according to claim 10, wherein at least three points of contact are maintained among said first clamping member with said first inclined distal surfaces of the plurality of mounting projections, said second clamping member with said second inclined distal surfaces of the plurality of mounting projections, and said lower mounting surface of the base with said upper mounting surfaces of the plurality of mounting projections.

12. The mount adapter device according to claim 10, wherein said first clamping member does not bear against said first inclined proximal surfaces of the plurality of mounting projections, and said second clamping member does not bear against said second inclined proximal surfaces of the plurality of mounting projections.

13. The mount adapter device according to claim 9, further comprising at least one projection disposed on said lower mounting surface, wherein said at least one projection engages an elected transverse groove of the rail upon attachment of the device to the rail.

14. The mount adapter device according to claim 13, wherein a portion of the push rod member protrudes from the bottom mounting surface thereby acting as one of said at least one projections.

15. The mount adapter device according to claim 1, wherein said push rod member includes a knob and a shaft, said knob being attached to a first end of said shaft.

16. The mount adapter device according to claim 15, wherein said resilient member is interposed between the knob of the push rod member and the first base member.

17. The mount adapter device according to claim 15, wherein a first end of said shaft has external helical threads which engage complimentary internal threads inside a central aperture in said knob for selectively advancing the knob along the shaft when the knob is rotated down the shaft in a direction toward the first base member and for selectively retracting the knob along the shaft when the knob is rotated up the shaft in a direction away from the first base member.

18. The mount adapter device according to claim 15, wherein said device is attached to said rail in a second locked position by pushing said push rod member in a direction which is transverse to the longitudinal axis of the rail, positioning the device on the rail, releasing said push rod member, and rotating said knob down the shaft of the push rod member in a direction toward the first base member until the knob is adjacent to the first base member and the push rod member can no longer be pushed.

19. The mount adapter device according to claim 15, further comprising a sealing member disposed around a lower portion of said knob so as to be interposed between the knob and the first base member when the mount adapter device is in a second locked position wherein the knob is adjacent to the first base member.

20. The mount adapter device according to claim 18, wherein said device is detached from the rail by rotating said knob up the shaft of the push rod member in a direction away from the first base member, pushing said push rod member in a direction which is transverse to the longitudinal axis of the rail, and lifting the device off the rail.

21. The mount adapter device according to claim 1, wherein the first clamping member and the second clamping member are approximately equal in length.

22. The mount adapter device according to claim 1, wherein said first base member further includes a first engagement member arranged and configured to engage the second base member when the device is in a closed position, such as when the device is not attached to the rail and is not being manipulated by a user.

23. The mount adapter device according to claim 22, wherein said second base member further includes a second engagement member arranged and configured to engage the first engagement member of the first base member when the device is in said closed position.

24. The mount adapter device according to claim 2, wherein said upper portion comprises a second rail to allow for direct attachment of an accessory to the second rail.

25. The mount adapter device according to claim 9, wherein said lower mounting surface further comprises a channel that is configured and arranged for receiving and slidably engaging a central portion of said push rod member.

26. The mount adapter device according to claim 13, wherein said at least one projection defines a locating member.

27. The mount adapter device according to claim 7, wherein upon releasing said push rod member, said first and second clamping members simultaneously move into locking engagement with the rail via two opposing and moving clamping forces.

* * * * *